US005455001A

United States Patent [19]

Hu

[11] Patent Number: 5,455,001

[45] Date of Patent: Oct. 3, 1995

[54] METHOD FOR MANUFACTURING INTERMETALLIC COMPOUND

[75] Inventor: Chen-Ti Hu, Taipei, Taiwan, Prov. of China

[73] Assignee: National Science Council, Taipei, Taiwan, Prov. of China

[21] Appl. No.: 272,119

[22] Filed: Jul. 7, 1994

Related U.S. Application Data

[63] Continuation-in-part of Ser. No. 125,318, Sep. 22, 1993.

[51] Int. Cl.[6] ..... B22F 3/24

[52] U.S. Cl. ..... 419/38; 419/10; 419/12; 419/23; 419/26; 419/28; 419/29; 419/30; 419/35; 419/54; 419/60; 419/69

[58] Field of Search ..... 419/10, 12, 23, 419/26, 28, 29, 30, 35, 38, 54, 60, 69

[56] References Cited

U.S. PATENT DOCUMENTS

| | | | |
|---|---|---|---|
| 4,609,528 | 9/1986 | Chang et al. | 419/62 |
| 4,613,480 | 9/1986 | Chang et al. | 419/30 |
| 4,661,156 | 4/1987 | Chang et al. | 75/246 |
| 4,676,829 | 6/1987 | Chang et al. | 75/246 |
| 4,762,679 | 8/1988 | Gegel et al. | 419/28 |
| 5,098,469 | 3/1992 | Rezhets | 75/249 |

*Primary Examiner*—Donald P. Walsh
*Assistant Examiner*—John N. Greaves
*Attorney, Agent, or Firm*—Christie, Parker & Hale

[57] ABSTRACT

A method for manufacturing an intermetallic compound comprises (a) preparing a powder, (b) canning said powder in a tube, (c) executing a first heat treatment to said tube-canned powder, and (d) treating said tube-canned powder for obtaining an intermetallic compound. This invention offers a simple, efficient, and inexpensive method for producing an intermetallic compound possessing excellent mechanical properties.

26 Claims, 8 Drawing Sheets

METHOD FOR MANUFACTURING INTERMETALLIC COMPOUND

FIELD OF THE INVENTION

The present invention is a continuation-in-part application of U.S. Ser. No. 08/125,318 filed on Sep. 22, 1993.

BACKGROUND OF THE INVENTION

The Ni-Al intermetallic compounds such as $Ni_3Al(\gamma')$ has demonstrated extraordinary properties: high melting point, high ordering energy, thermal hardening, good resistance to oxidation and relatively small density. Those properties make it attractive for aerospatial and structural applications at elevated temperatures.

One of the techniques for forming the Ni-Al intermetallic compounds is obtained by vacuum melting and vacuum casting which is mostly used by the Metals and Ceramics Division of Oak Ridge National Laboratory, U.S.A. Owing to the following suffered disadvantages: a) the metal-crucible interactions are prone to be caused during the melting and casting, b) the cast is apt to have shrinking pores, and c) the cast is too hard to be worked, there are many difficulties encountered according to this technique.

Another technique for forming the Ni-Al intermetallic compound is the powder metallurgy (PM). This technique can permit us to obtain a compound with a relatively high yield rate, accurate dimensions, and a satisfactory microstructure and to easily control the components thereof.

One of the powder metallurgy techniques is the sintering of pre-alloyed powder which mainly processes by the rapid solidification process (RSP), the powder or ribbons by hot isostatic pressing or hot extrusion. Although the final sintered product is of a high density, there is still a key disadvantage: this technique includes too many procedures which have to employ expensive equipment and operate under a protective atmosphere. Besides, the hardness of the pre-alloyed powder is so high that the green forged parts cannot be easily formed and will wear the mold off easily.

Another powder metallurgy technique is the mechanical alloying which processes the pure metal powder in a protective atmosphere by the high-energy ball milling to lower the sintering temperature. According to this technique, some dispersion strengthening particles are added to achieve grain refining and strength increasing. The disadvantages of this technique are, a) the procedure takes too much time, b) the obtained powder is so hard that the pressure for formation is therefore high, c) the ball-milling step causes the pollution problem, and d) the sintering density after the ball milling procedure is lowered.

A further powder metallurgy technique is the reactive sintering. This technique uses the inexpensive elemental metal powder which is softer than the pre-alloyed powder for the initial material, so there are the following advantages: a) the formation thereof is easy to be obtained, b) the sintering temperature can be lowered down to a large scale, and c) the sintering time can be shortened. Whereas, there are also disadvantages: a) the pores are prone to be generated when the reaction heat and the difference of the elemental diffusion rates are high, b) the densification is hard to be obtained, c) the protective atmosphere such as argon, hydrogen, and helium is necessary for preventing the oxidation of aluminum powder, and d) the densified compound is sensitive to the processing parameters such as the heating rate, the interfacial quality, the temperature, and the particle size. It is also noted that if a high density sintered body is to be obtained, a higher heating rate, a finer powder (in μm order) and an externally applied pressure during sintering are all needed, but the equipment that meets the above requirements are extremely expensive.

A further technique for forming the Ni-Al compounds is the chemical technique. The initial material $NiCl_2$ and $AlCl_3$ are processed by the co-deposition method to obtain a nickel-aluminum organometallic complex. After a first thermal treatment lower than 1000° C. to burn off the organic function groups to obtain the mixture of $Ni_3C$ and the non-crystalline $Al_2O_3$ and free carbon, and after a second stage of heat treatment above 1300° C. to obtain the intermetallic compound, the $Ni_3Al$ and NiAl powder whose diameters are below 3 μm are formed. Whereas, this technique whose cost is too high and whose speed is too slow cannot economically meet with the industrial demand.

It is therefore attempted by the Applicant to deal with the above situations encountered by the prior art.

SUMMARY OF THE INVENTION

An object of the present invention is to provide a simple way to obtain an Ni-Al intermetallic compound having excellent physical and mechanical properties.

Another object of the present invention is to provide an electroless plating method for producing the family of Ni-Al compounds (i.e., $Ni_3Al$, NiAl, etc.) inexpensively, effectively, and quickly.

Another object of the present invention is to provide an electroless plating method for producing the family of Ni-Al compounds by replacement reaction to form a nickel layer on the surface of the aluminum powder as an Ni-Al composite powder.

Another object of the present invention is to provide a preparing method of an Ni-Al compound by oxidation and reduction reaction to deposit the reduced nickel ions on the nickel layer of the Ni-Al composite powder.

Another object of the present invention is to provide a method especially suitable for executing plating action on the surface of the powder.

Another object of the present invention is to provide a composite powder softer than both the pre-alloyed powder and the mechanical alloying powder to be easily formed.

Another object of the present invention is to provide an electroless plating method of an Ni-Al compound which can shorten the diffusion distance for forming the Ni-Al intermetallic compounds.

Another object of the present invention is to provide an Ni-Al intermetallic compound having a higher constituent uniformity.

Another object of the present invention is to provide an Ni-Al intermetallic compound preparing method whose electroless plating solution containing boron to be ions permits boron uniformly distributed in the plating layer.

Another object of the present invention is to provide an Ni-Al intermetallic compound preparing method which can solve the difficult problems of processing and formation for the compounds.

Another object of the present invention is to provide an Ni-Al intermetallic compound preparing method which applies inexpensive and simple equipment.

Another object of the present invention is to provide an

Ni-Al intermetallic compound whose nickel layer can lessen or avoid the oxidation of the aluminum powder.

In accordance with the present invention, a method for manufacturing an intermetallic compound comprises: (a) preparing a powder, (b) canning the powder in a tube, (c) executing a first heat treatment to the tube-canned powder, and (d) processing the tube-canned powder for obtaining an intermetallic compound.

In accordance with another aspect of the present invention, step (d) includes a step of rolling the tube-canned powder which is a cold-rolling process.

In accordance with another aspect of the present invention, after step (d) the invention further comprises a step (e) of executing a second heat treatment to the processed powder, a step (f) of decanning the processed powder from the tube, and a step (g) of cold-rolling and homogenizing the processed powder.

In accordance with another aspect of the present invention, step (g) is executed at about 1200° C.

In accordance with another aspect of the present invention, the second heat treatment includes steps of pre-sintering and sintering the processed powder.

In accordance with another aspect of the present invention, the pre-sintering step is executed at a temperature of about 650° and the sintering step is executed at a temperature of about 1200° C.

In accordance with another aspect of the present invention, the first heat treatment is executed in a vacuum furnace at about 450° C. with less than about $10^{-3}$ Pa to degas the mixture.

In accordance with another aspect of the present invention, step (a) includes (1a) providing a reducing solution including a reducing agent and a first ions, (2a) providing a first metal powder, (3a) adding a proper amount of a second metal powder to the reducing solution, and (4a) permitting the reducing agent to reduce the first ions to be deposited on the second metal powder for forming a first composite powder.

In accordance with another aspect of the present invention, the first ions are nickel ions, the first metal powder is a nickel powder having a purity about 99.9% and an average diameter about 5 μm, and the second metal powder is an aluminum powder.

In accordance with another aspect of the present invention, the reducing solution further including a second ions which are boron ions.

In accordance with another aspect of the present invention, the intermetallic compound is one selected from a group consisting of $Ni_3Al$, NiAl, $Ni_2Al_3$, $NiAl_3$, $Ni_3Al$+B, NiAl+B, $Ni_2Al_3$+B, and $NiAl_3$+B.

In accordance with another aspect of the present invention, the first composite powder is a Ni-B-Al composite powder.

In accordance with another aspect of the present invention, the step (a) further includes (5a) adding a proper amount of the first metal powder in the reducing solution for forming a second composite powder and (6a) obtaining a powdery mixture of the first and second composite powders.

In accordance with another aspect of the present invention, the second composite powder is a Ni-B-Ni composite powder.

In accordance with another aspect of the present invention, the tube is a metal tube such as a stainless steel tube.

The present invention can be more fully understood by reference to the following description and accompanying drawings which form an integral part of this application:

DETAILED DESCRIPTION OF THE PREFERRED EMBODIMENT

Generally speaking, there are three ways to reduce metal ions in a solution to be deposited on an article: 1) the electroplating, 2) the chemical reducing plating, and 3) the replacing plating. According to the present invention, there are in fact the chemical reducing plating and the replacing plating included. That is to say, first, the nickel ions in the replacing plating solution replace the aluminum ions ionized from the aluminum powder to form a mono-atomic nickel layer on the surface of the powder; secondly, the reducing agent in the reducing solution permits the reduced nickel and boron ions to be deposited on the nickel layer. Because nickel has a property of spontaneous catalysis, the thickness of the nickel layer can be precisely controlled only if the adhesion between the surface of the aluminum powder and the nickel layer is satisfactory and only if the stability of the plating solution is as desired.

The electroless plating solution chiefly contains a metal salt and a reducing agent. For improving the reducing speed and for prolonging the life of the plating bath, the solution further contains a pH regulator, a buffer, a complexing agent, a stabilizer, and an improver.

Figure 1:
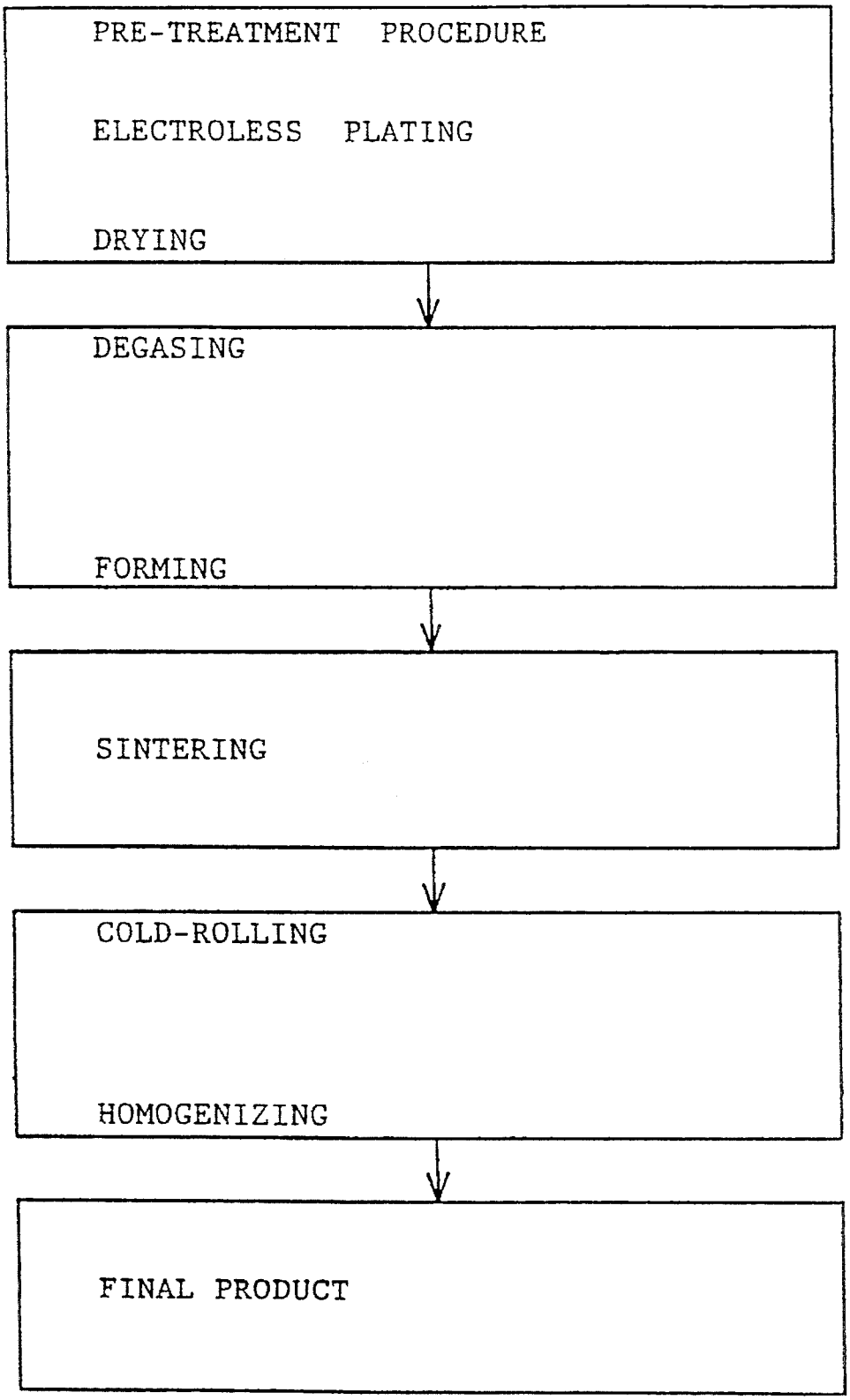
FIG. 1 is a flow chart according to the present invention.

A preparing method according to the present invention is shown in FIG. 1, and the key steps are discussed in detail as follows:

A) ELECTROLESS PLATING

The aluminum powder whose purity is above 99.5% and whose average diameter is 22 μm is obtained from CERAC Co.. Besides, for adjusting the boron content of the $Ni_3Al$+B intermetallic compound to be about 0.1 wt % and for adjusting the nickel content of the compound, a proper amount of nickel powder (of 99.9% purity, average diameter 5 μm, marketed by CERAC Co.) is added into the electroless plating solution at a proper time.

The electroless plating includes the replacing plating and the reducing plating:

I) REPLACING PLATING

There are two possible replacing plating conditions shown as follows:

| CONDITION A | |
|---|---|
| nickel chloride ($NiCl_2.6H_2O$) | 15 g/l |
| sodium citrate ($Na_3C_6H_5O_7.2H_2O$) | 20 g/l |
| ammonium chloride ($NH_4Cl$) | 6 g/l |
| pH value of the replacing solution regulated by ammonia water ($NH_4OH$) | 10 |
| reaction temperature | room temperature |
| CONDITION B | |
| nickel chloride ($NiCl_2.6H_2O$) | 30 g/l |
| sodium citrate ($Na_3C_6H_5O_7.2H_2O$) | 20 g/l |
| ammonium chloride ($NH_4Cl$) | 7 g/l |
| sodium fluoride (NaF) | 0.5 g/l |
| pH value of said replacing solution regulated by ammonia water ($NH_4OH$) | 8.5 |
| reaction temperature | room temperature |

Compared to the conventional pre-treatment procedures such as defatting the aluminum powder, flushing the aluminum powder with a basic solution, and flushing the aluminum powder with an acid solution, the replacing plating procedure performs effectively. Because the conventional defatting, flushing with a basic solution, and flushing with an acid solution cause a large amount of weight loss of aluminum during the pre-treatment procedure, an appropriate replacing plating is more suitable for pre-treating aluminum plates, aluminum flakes, and aluminum powder of large size. The difference between Condition A and Condition B is that some amount of NaF is added in Condition B to etch $Al_2O_3$ for lowering the pH value of the solution. That is to say, the weak acid NaF with $Cl^-$ and $F^-$ can etch away $Al_2O_3$ to execute the replacing reaction.

II) REDUCING PLATING

There are nine possible reducing plating conditions shown as follows:

| CONDITION 1 | |
|---|---|
| nickel chloride ($NiCl_2.6H_2O$) | 72 g/l |
| dimethylamine borane (DMAB) | 6 g/l |
| sodium acetate ($CH_3COONa.3H_2O$) | 22 g/l |
| lead nitrate ($Pb(NO_3)_2$) | 2 ppm |
| pH value | 6–7 |
| reaction temperature | 70° C. |
| CONDITION 2 | |
| nickel chloride ($NiCl_2.6H_2O$) | 60 g/l |
| dimethylamine borane (DMAB) | 10 g/l |
| sodium citrate ($Na_3C_6H_5O_7.2H_2O$) | 100 g/l |
| ammonium chloride ($NH_4Cl$) | 50 g/l |
| lead nitrate ($Pb(NO_3)_2$) | 2 ppm |
| pH value | 7–8 |
| reaction temperature | 70° C. |
| CONDITION 3 | |
| nickel chloride ($NiCl_2.6H_2O$) | 50 g/l |
| ammonia water ($NH_4OH$) | 5 g/l |
| dimethylamine borane (DMAB) | 50 ml/l |
| ammonium chloride ($NH_4Cl$) | 5 g/l |
| reaction temperature | room temperature |
| CONDITION 4 | |
| nickel chloride ($NiCl_2.6H_2O$) | 15 g/l |
| dimethylamine borane (DMAB) | 4 g/l |
| sodium citrate ($Na_3C_6H_5O_7.2H_2O$) | 20 g/l |
| ammonia water ($NH_4OH$) | 50 ml/l |

-continued

| | |
|---|---|
| reaction temperature | room temperature |
| CONDITION 5 | |
| nickel chloride ($NiCl_2.6H_2O$) | 30 g/l |
| dimethylamine borane (DMAB) | 3.5 g/l |
| malonic acid ($HOOCCH_2COOH$) | 40 g/l |
| thiourea ($NH_2COSC_2H_5$) | 1 ppm |
| pH | 6–7 |
| reaction temperature | 70° C. |
| CONDITION 6 | |
| nickel chloride ($NiCl_2.6H_2O$) | 60 g/l |
| sodium borohydride ($NaBH_4$) | 2 g/l |
| sodium citrate ($Na_3C_6H_5O_7.2H_2O$) | 100 g/l |
| ammonium chloride ($NH_4Cl$) | 50 ml/l |
| lead nitrate ($Pb(NO_3)_2$) | 5 ppm |
| pH | 7–8 |
| reaction temperature | room temperature |
| CONDITION 7 | |
| nickel chloride ($NiCl_2.6H_2O$) | 60 g/l |
| sodium borohydride ($NaBH_4$) | 3 g/l |
| ammonium water ($NH_4OH$) | 200 ml/l |
| lead nitrate ($Pb(NO_3)_2$) | 2 ppm |
| pH | 8–10 |
| reaction temperature | room temperature |
| CONDITION 8 | |
| nickel chloride ($NiCl_2.6H_2O$) | 30 g/l |
| sodium borohydride ($NaBH_4$) | 2 g/l |
| ammonium chloride ($NH_4Cl$) | 5 g/l |
| sodium citrate ($Na_3C_6H_5O_7.2H_2O$) | 10 g/l |
| sodium acetate ($CH_3COONa.3H_2O$) | 20 g/l |
| lead nitrate ($Pb(NO_3)_2$) | 5 ppm |
| pH | 8–10 |
| reaction temperature | room temperature |
| CONDITION 9 | |
| nickel acetate ($Ni(C_2H_3O_2)_2.4H_2O$) | 60 g/l |
| hydrazine hydrate ($N_2H_4.H_2O$) | 100 ml/l |
| 2-hydroxylacetic acid ($HOCH_2COOH$) | 60 ml/l |
| ethylenediaminetetraacetic acid (EDTA) | 25 g/l |
| pH | 8–10 |
| reaction temperature | 80° C. |

Figure 2A:
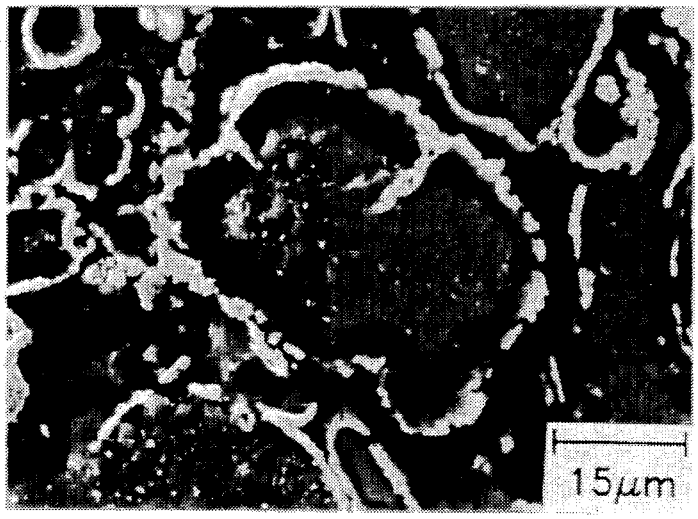
FIGS. 2*a* and 2*b* are two SEM photographs which show the composite powders according to two improper plating conditions (at a pH value of 12)
Figure 2B:
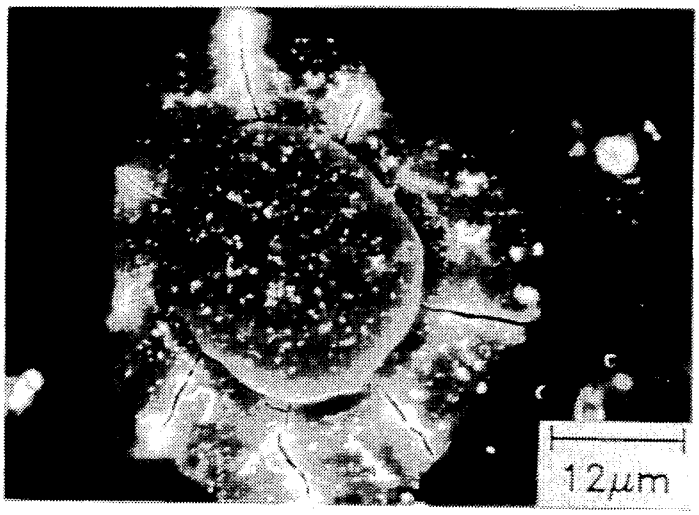
Figure 3A:
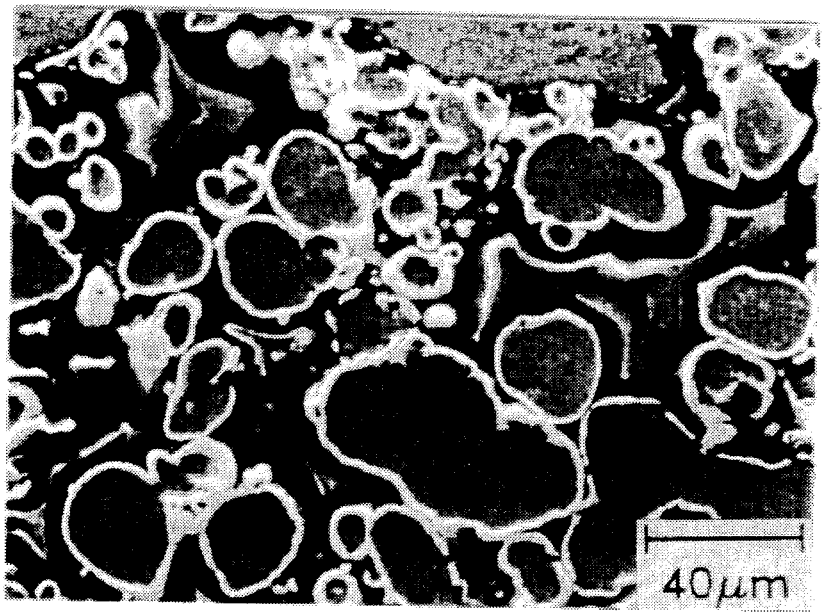
FIGS. 3*a* and 3*b* are two SEM photographs which show the composite powders according to two proper plating conditions.
Figure 3B:
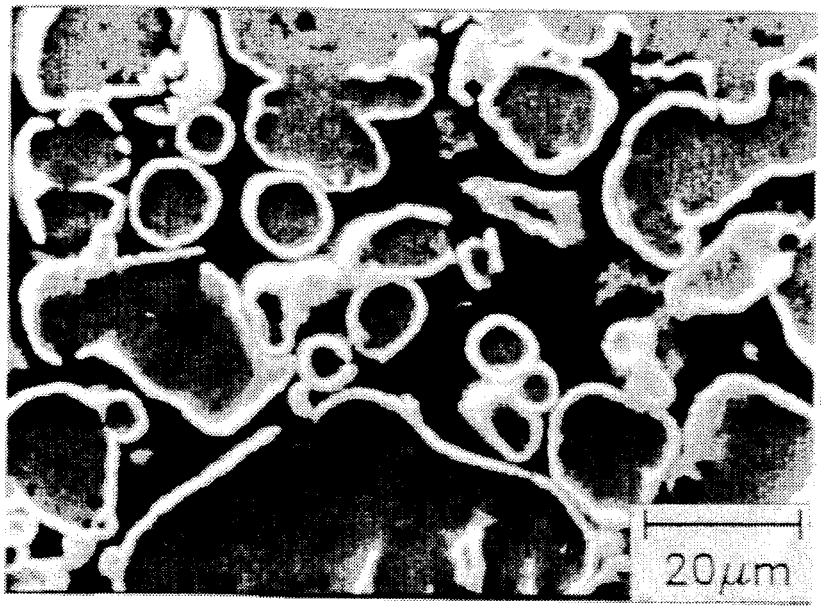
Figure 4:
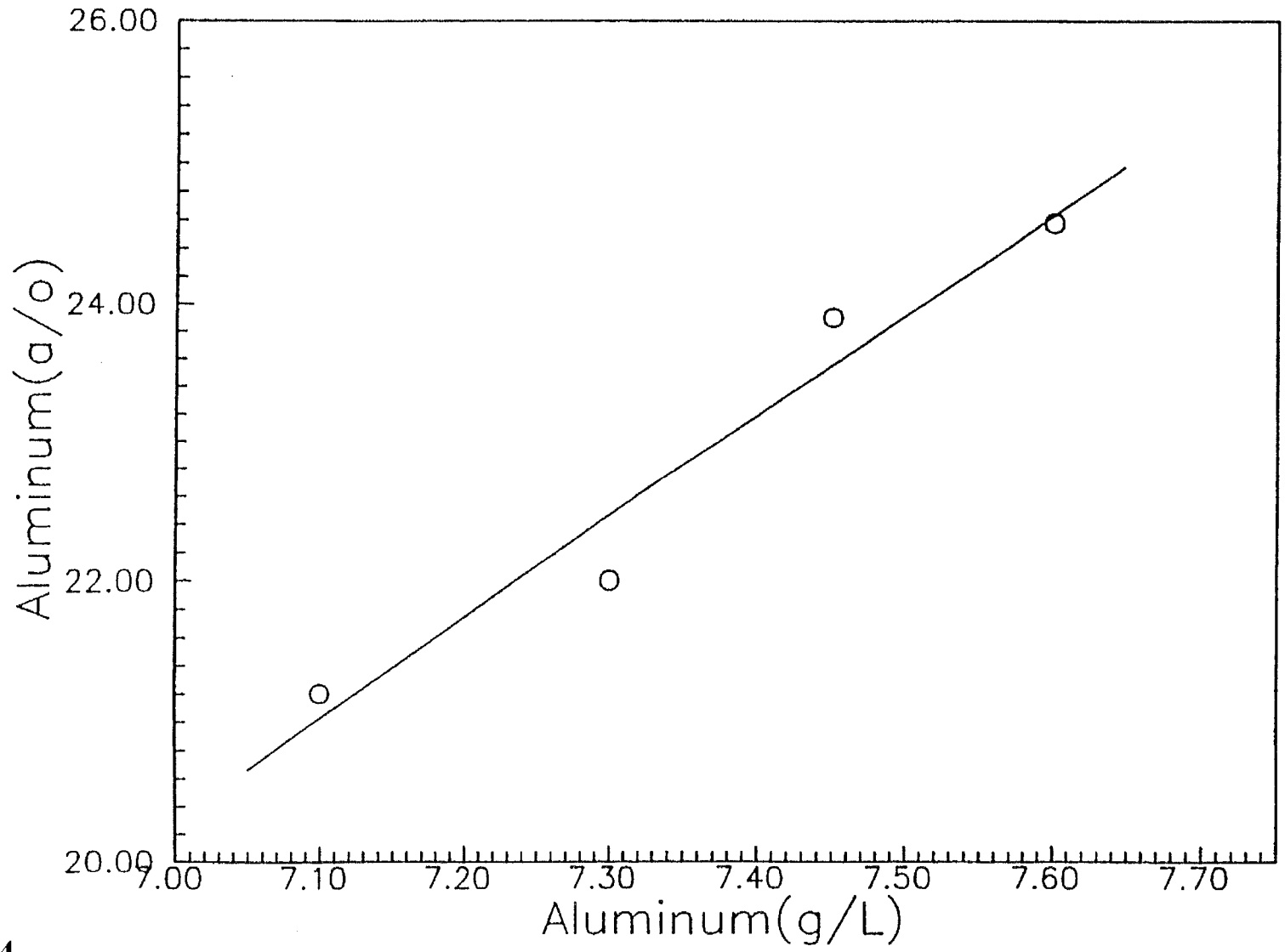
FIG. 4 shows a relation between the Al content of the Ni-Al compound and the weight of the added aluminum powder by varying the weight of the added aluminum powder at a certain plating condition 4.

After the replacing plating and reducing plating procedures, a mixture of Ni-B-Ni and Ni-B-Al composite powders is formed. Owing to the high activity of aluminum, the aluminum is prone to react with $H^+$ and $OH^-$ in the solution to form an aluminum hydroxide, so the pH value of the reducing solution is chosen to the neutral point and the reaction rate is chosen higher to lessen the time of the aluminum contacting with the solution. FIG. 2 shows a composite powder obtained through an improper plating condition (having a too high pH value). As shown in FIG. 2, there is a gray middle layer with fractures formed between aluminum and nickel. The fractures can be caused by the shrinkage of a glutinous aluminum hydroxide after the aluminum hydroxide is dried. FIG. 3 obtained by an SEM (CamScan) shows a composite powder through a proper plating condition allowing the aluminum particle to be covered by an uniform nickel layer. Comparing FIG. 2 with FIG. 3, we can find that there is no middle layer between nickel and aluminum in FIG. 3, and the subsequent steps such as forming and sintering ones show that this composite powder obtained in a proper plating condition performs well. Thus, the excellent Ni-Al interface quality is indirectly proved. The small white particles in FIG. 3 are a proper amount of nickel powder added into the reducing solution at five minutes before the reducing plating procedure is completed, and the object is to control the Ni and Al ratio of the Ni-Al compound and the concentration of boron. Although the boron content of the Ni-B alloy layer obtained by using DMAB as a reducing agent varies as the plating condition varies, the lowest boron content thereof is about 1% is much higher than the most proper boron content 0.1%. So, to add therein the nickel powder permits the boron content to be reduced to 0.1%. Table 1 shows the analysis results by ICP AES. The boron contents of different Ni-Al powder portions are all about 0.1%, and the contents of other metals such as Fe and Cu coming from the impurities in the reducing plating solution are relatively few. FIG. 4 shows the relation between the Al content of the Ni-Al compound and the weight of the added aluminum powder by varying the weight of added aluminum powder at a certain plating condition 4.

TABLE 1

| Add. | 7.10 g/l | 7.30 g/l | 7.45 g/l | 7.60 g/l |
|---|---|---|---|---|
| Ni | balance | balance | balance | balance |
| Al | 21.23 at % | 22.04 at % | 23.89 at % | 24.62 at % |
| B | 0.119 wt % | 0.107 wt % | 0.125 wt % | 0.122 wt % |
| S | 0.002 wt % | 0.002 wt % | 0.002 wt % | 0.002 wt % |
| Fe | 0.0051 wt % | 0.0054 wt % | 0.0056 wt % | 0.0057 wt % |
| Cu | 0.0003 wt % | 0.0003 wt % | 0.0003 wt % | 0.0003 wt % |

B) FORMING

The mixture of Ni-B-Ni and Ni-B-Al composite powders is first canned in a 304 stainless steel tube in air, then both ends of the tube are mechanically sealed to form a canister. Thus, the mixture is processed by a first thermal treatment with less than $10^{-3}$ Pa at 450° C. in a vacuum tube furnace to be degassed, and a cold rolling to about 60% reduction in area is followed to form test flakes. It is noted that the composite powders absorb therein the hydrogen atoms generated during the electroless plating procedure because of the 20 excellence in the hydrogen-absorbing behavior of nickel, then the degassing procedure is therefore very important.

C) SINTERING, COLD-ROLLING, AND HOMOGENIZING

Figure 5:
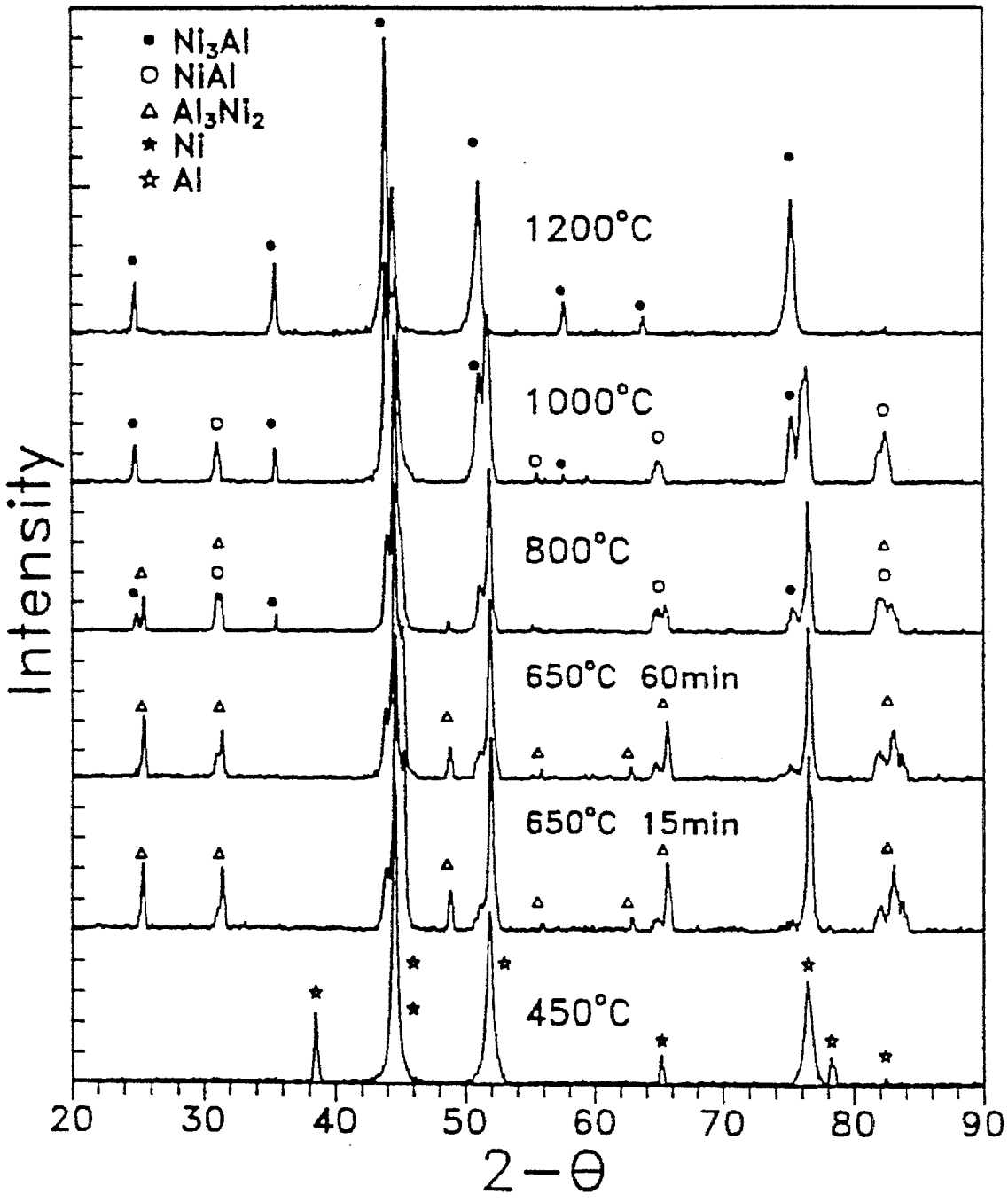
FIG. 5 shows X-ray diffraction patterns of various stages in the sintering process.
Figure 6:
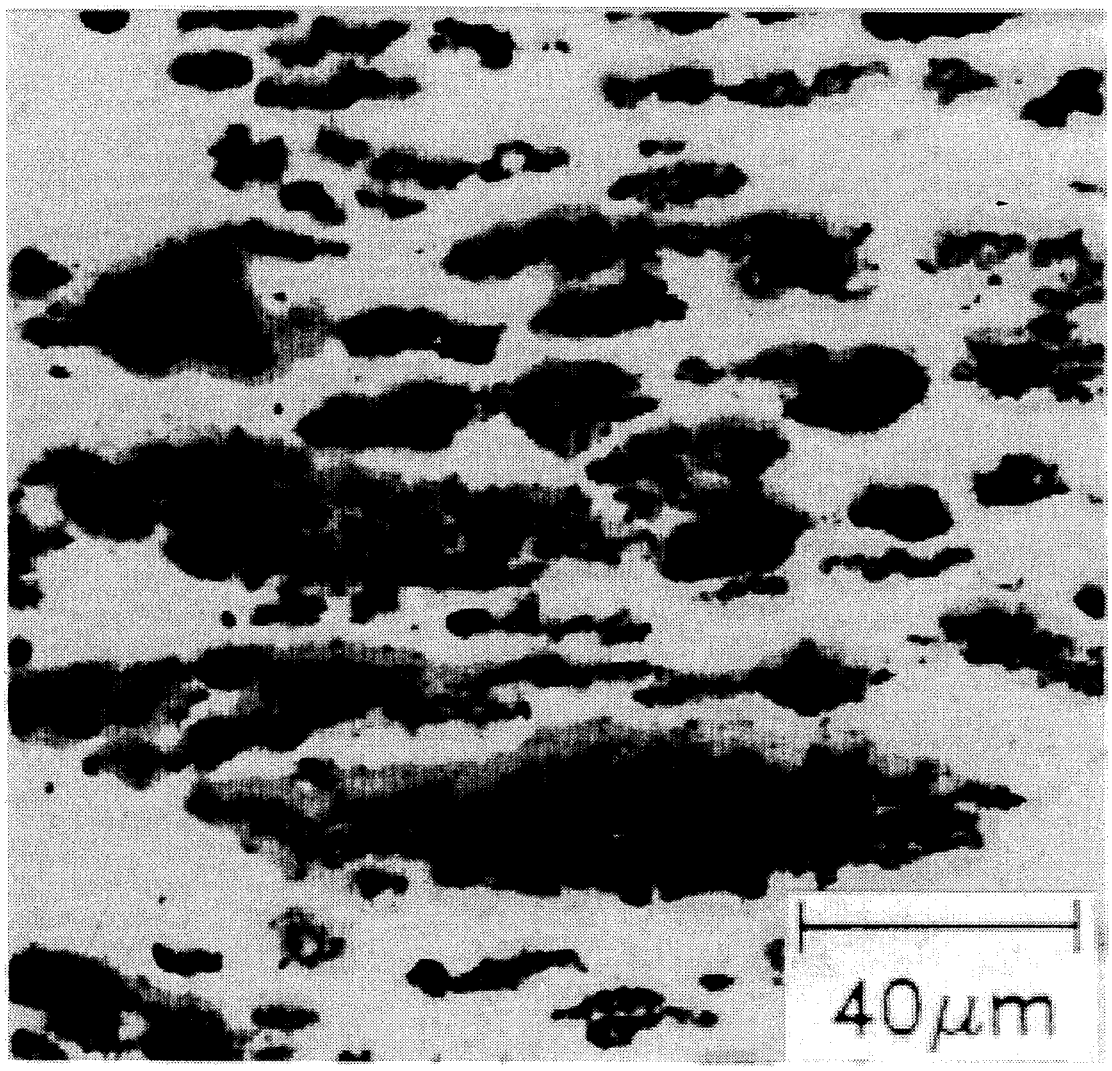
FIG. 6 is a photograph taken with a metallograph showing the microstructure of a sample made of mixed composite powders after a heat treatment at 650° C. in 30 minutes.

The test flakes are processed by a second heat treatment at 650° C. to form a pre-sintered specimens, which are then reduced 30% in area by cold-rolling in a DBR-250 rolling mill and sintered at 1200° C. for two hours in the same furnace. After being released from the canister, the sintered specimens are cold-rolled to another 26% reduction in area and homogenized at 1200° C. for four hours in the same furnace. The X-ray diffraction patterns of the specimen in various steps in the sintering process are shown in FIG. 5. Comparing the two situations at 650° C. for 15 minutes and at 650° C. for 60 minutes, we can find that the prolongation of the specimen in the pre-sintering period from 15 minutes heat-treatment to 60 minutes heat-treatment does not significantly affect the relative intensity of each phase in the X-ray diffraction spectrum. FIG. 6 shows the metallograph of the specimen after a heat treatment at 650° C., and we find that the black portions are pores being as large as the aluminum particle, so the portions should be pores generated from the reaction of aluminum and nickel. Around the pores there is an area of a gray thick layer, and according to the XRD patterns in FIG. 5 we know that this gray area consists of $Al_3Ni_2$. From above discussions, we know that the reaction mechanisms for forming the composite flakes at 650° C. are as follows: the atomized aluminum powders reacting with the nickel layer to form a new phase so that the compound $Al_3Ni_2$ and a large amount of reaction heat are generated, and the reaction heat in turn elevates the local temperature of the flakes so that there is a transient liquid existing between the powder to speed up the reaction; whereas the formed compound whose melting point is higher and the diffusion rate of nickel and aluminum in the compound is slower so that the rate of nickel reacting with $Al_3Ni_2$ is slowed down, thus the composition at 650° C. heat-treatment for 15 minutes and 650° C. for 60 minutes are almost the same; the reaction of aluminum and nickel to form the Ni-Al compound is one which causes the entire volume to be shrunk, so there are generated pores whose sizes are similar to the ones of the aluminum particles, and by the fact that a gray layer of a second phase developing around the inner wall of each pore has a uniform thickness and that there is no un-reacted aluminum left, it can be proved that the interface quality between nickel and aluminum is satisfactory. From FIG. 5, we also know that the reacting mechanisms of the transformation from Ni and Al to $Ni_3Al$ are $Ni+Al \rightarrow Ni+Al_3Ni_2 \rightarrow Ni+NiAl+Al_3Ni_2 \rightarrow Ni+NiAl+Ni_3Al \rightarrow Ni_3Al$. In other words, the intermetallic compound containing higher content of aluminum is first formed in the entire reaction, and the formation rate (especially of $Al_3Ni_2$) is very fast which is achieved chiefly by means of a fast diffusion rate made possible by a transient liquid state. The post solid in this stage diffuses into a homogenized mechanism gradually formed into an intermetallic compound having a higher nickel content as the temperature is raised and the time passes to finally obtain the Ni Al of a mono-phase.

Figure 7:
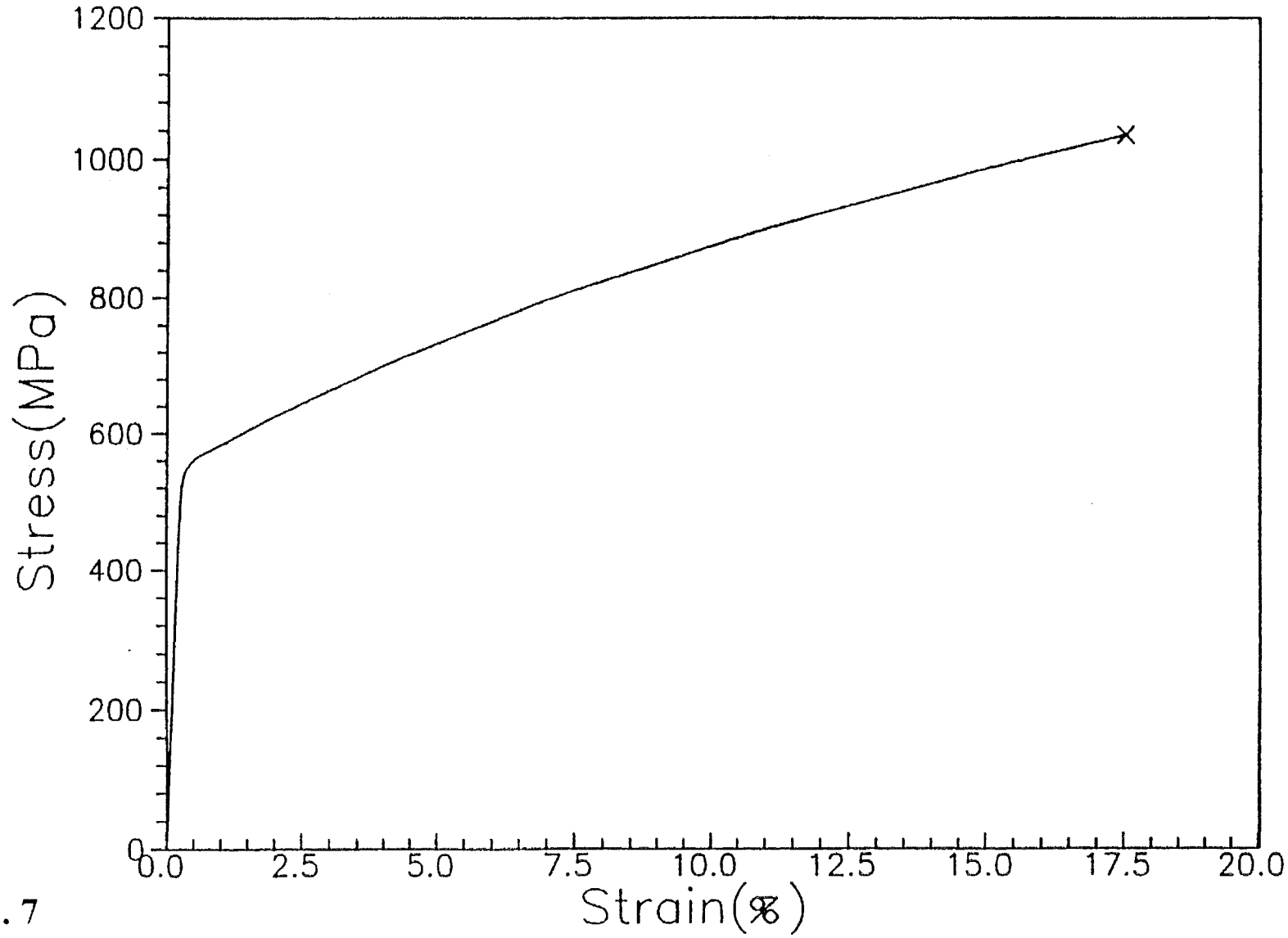
FIG. 7 is a tensile test stress-strain curve for a composite powder metallurgy (CPM) specimen.
Figure 8:
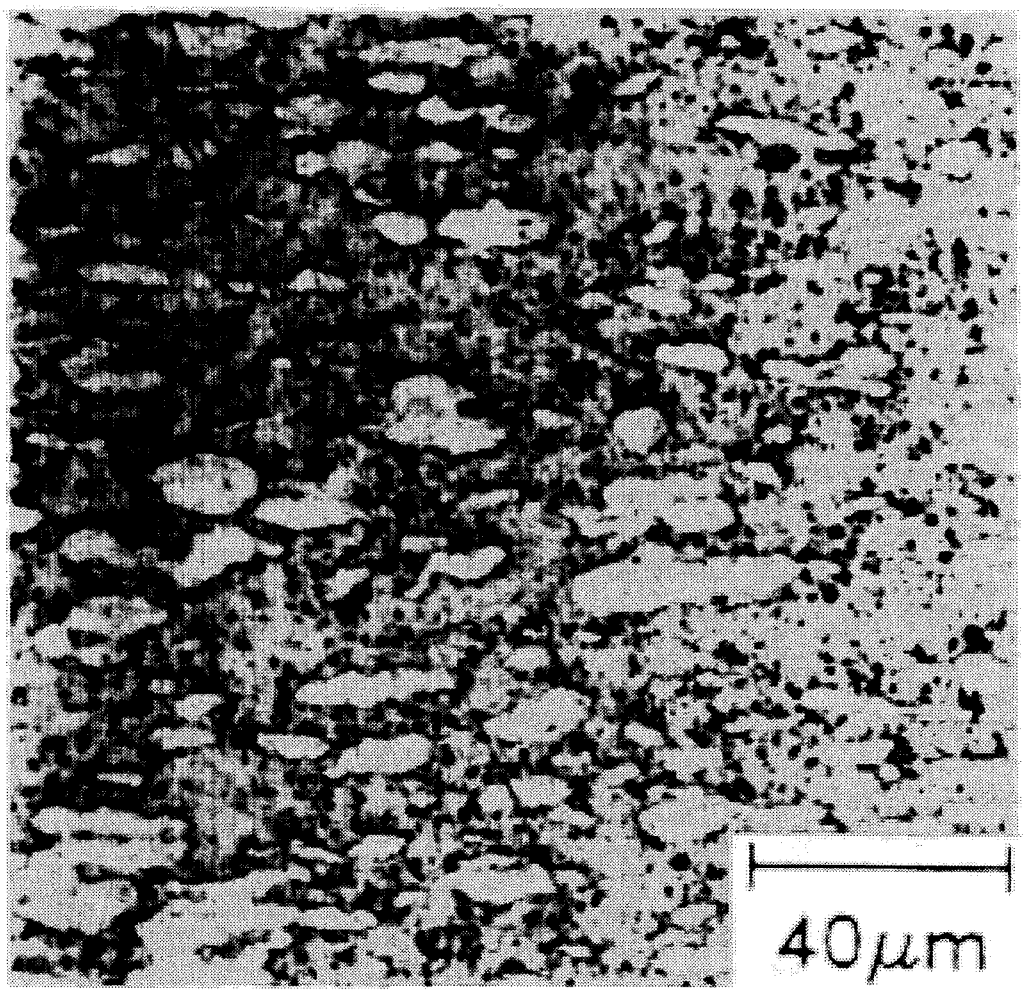
FIG. 8 is a photograph taken with a metallograph of a test piece processed by a thermal treatment at 1200° C. in 8 hours.

In addition, the physical properties of the specimen are discussed now. The tensile tests were performed on specimens of gauge length 25.4 mm (ASTM standard) at room temperature, and a testing machine (MTS 810) with an initial strain rate $1.0\times10^{-4}$ $sec^{-1}$ was employed. The test record is obtained from a X-Y recorder and a personal computer. FIG. 7 is a typical tensile test stress-strain curve for an air test specimen. The test is conducted on a specimen obtained by a composite powder metallurgy (CPM) where the aluminum content ranges from 23 a/o to 25 a/o. Its elasticity ranges from 160 GPa to 200 GPa which respectively correspond to theoretic values. Its yield strength ranges from 420 MPa to 580 MPa which is twice that of a vacuum molten test piece. Its elongation percentage ranges only from 12% to 17% which is higher than that of most $Ni_3Al$+B compounds produced by other powder metallurgy methods. FIG. 8 shows a metallograph of a test piece processed by a homogenizing procedure at 1200° C. for eight hours.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for manufacturing an intermetallic compound comprising steps of:

(a) preparing a powder;

(b) canning said powder in a tube;

(c) executing a first heat treatment to said tube-canned powder;

(d) cold-rolling said tube-canned powder; and (e) executing a second heat treatment to said cold-rolled powder for obtaining an intermetallic compound.

2. A method as claimed in claim 1, further comprising a step (f) of decanning said resulting powder from said tube after said second heat-treatment step (e).

3. A method as claimed in claim 2, further comprising a step (g) of cold-rolling and homogenizing said decanned powder after said step (f).

4. A method as claimed in claim 3, wherein said homogenizing procedure of said step (g) is executed at about 1200° C.

5. A method as claimed in claim 1, wherein said second heat treatment step (e) includes a step of pre-sintering said cold-rolled powder.

6. A method as claimed in claim 5, wherein said pre-sintering step is executed at a temperature of about 650° C.

7. A method as claimed in claim 5, wherein second heat treatment step (e) further includes a step of sintering said pre-sintered powder.

8. A method as claimed in claim 7, wherein said sintering step is executed at a temperature of about 1200° C.

9. A method as claimed in claim 1, wherein said first heat treatment is executed in a vacuum furnace.

10. A method as claimed in claim 9, wherein said first heat treatment is executed at about 450° C. with less than about $10^{-3}$ Pa to degas said mixture.

11. A method as claimed in claim 1, wherein said step (a) includes steps of:

(1a) providing a reducing solution including a reducing agent and a first ions;

(2a) providing a first metal powder;

(3a) adding a proper amount of a second metal powder to said reducing solution; and (4a) permitting said reducing agent to reduce said first ions to be deposited on said second metal powder for forming a first composite powder.

12. A method as claimed in claim 11, wherein said first ions are nickel ions.

13. A method as claimed in claim 11, wherein said first metal powder is a nickel powder.

14. A method as claimed in claim 13, wherein said nickel powder has a purity about 99.9% and an average diameter about 5 μm.

15. A method as claimed in claim 11, wherein said second metal powder is an aluminum powder.

16. A method as claimed in claim 11, wherein said intermetallic compound is one selected from a group consisting of $Ni_3Al$, NiAl, $Ni_2Al_3$, and $NiAl_3$.

17. A method as claimed in claim 11, wherein said reducing solution further including a second ions.

18. A method as claimed in claim 17, wherein said second ions are boron ions.

19. A method as claimed in claim 18, wherein said intermetallic compound is one selected from a group consisting of $Ni_3Al$+B, NiAl+B, $Ni_2Al_3$+B, and $NiAl_3$+B.

20. A method as claimed in claim 18, wherein said first composite powder is a Ni-B-Al composite powder.

21. A method as claimed in claim 11, wherein said step (a) further includes steps of:

(5a) adding a proper amount of said first metal powder in said reducing solution for forming a second composite powder; and (6a) obtaining a powdery mixture of said first and second composite powders.

22. A method as claimed in claim 21, wherein said second composite powder is a Ni-B-Ni composite powder.

23. A method as claimed in claim 1, wherein said tube is a metal tube.

24. A method as claimed in claim 23, wherein said metal tube is a stainless steel tube.

25. A method as claimed in claim 1, wherein said second heat treatment is executed in a vacuum furnace.

26. A method as claimed in claim 4, wherein said homogenizing procedure of said step (g) is executed in a vacuum furnace.

* * * * *

UNITED STATES PATENT AND TRADEMARK OFFICE

CERTIFICATE OF CORRECTION

PATENT NO. : 5,455,001

DATED : October 3, 1995

INVENTOR(S) : Chen-Ti Hu

It is certified that error appears in the above-indentified patent and that said Letters Patent is hereby corrected as shown below:

On the Title Page, Item [75] Inventor, delete "Prov. of China" and insert therefor -- R.O.C. --.

On the Title Page, Item [73] Assignee, delete "Prov. of China" and insert therefor -- R.O.C. --.

Column 3, line 26, change "500°" to -- 650°C --.
Column 4, line 27, change "hours;" to -- hours. --.
Column 6, line 56, change "an uniform" to -- a uniform --.
Column 7, line 41, change "specimens" to -- specimen --.
Column 8, line 26, change "Ni Al" to -- Ni-Al --.
Column 10, line 10, after "including" delete -- a --.

Signed and Sealed this

Twenty-third Day of April, 1996

Bruce Lehman

*Attest:*

BRUCE LEHMAN

*Attesting Officer*

*Commissioner of Patents and Trademarks*